US007182047B1

(12) United States Patent
Schwartz

(10) Patent No.: US 7,182,047 B1
(45) Date of Patent: Feb. 27, 2007

(54) COOLING FAN SYSTEM FOR AUTOMOTIVE VEHICLE

(75) Inventor: William Schwartz, Pleasant Ridge, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 11/306,787

(22) Filed: Jan. 11, 2006

(51) Int. Cl.
*F01P 7/02* (2006.01)
*F01P 7/10* (2006.01)

(52) U.S. Cl. ..... 123/41.04; 123/41.11; 123/41.49

(58) Field of Classification Search ..... 123/41.04, 123/41.05, 41.06, 41.07, 41.11, 41.12, 41.49; 415/115, 145, 146
See application file for complete search history.

(56) References Cited

U.S. PATENT DOCUMENTS 2,351,203 A * 6/1944 Hanson ..... 123/41.04
5,660,149 A 8/1997 Lakerdas et al.
6,045,327 A 4/2000 Amr
6,106,228 A 8/2000 Bartlett
6,309,178 B1 10/2001 Kim et al.
6,342,741 B1 1/2002 Fukui et al.
6,450,760 B1 9/2002 Furukawa et al.
6,827,547 B2 12/2004 Robb
6,832,644 B2 12/2004 Stauder et al.
2004/0223845 A1 11/2004 Caplan et al.

* cited by examiner

*Primary Examiner*—Noah P. Kamen
(74) *Attorney, Agent, or Firm*—Gary A. Smith

(57) ABSTRACT

A cooling system for an internal combustion engine mounted within a vehicle includes a radiator for rejecting heat to ambient air and an axial fan mounted within a fan shroud associated with a radiator. The fan has a stationary hub equipped with louvers which may be controlled so as to either block off or allow airflow through the hub, and consequentially through the radiator. In this manner, the airflow past the fan may be greatly increased when the vehicle is operated at a higher groundspeed, while decreasing the amount of power consumed by the fan.

20 Claims, 3 Drawing Sheets

COOLING FAN SYSTEM FOR AUTOMOTIVE VEHICLE

BACKGROUND OF THE INVENTION

The present invention relates to a fan system for drawing ambient air through the radiator of an internal combustion engine cooling system.

Both engine-driven and hydraulic or electrically-driven radiator cooling fans have been used for almost a century with internal combustion engines. Such cooling fans typically include a multi-bladed element mounted upon a centrally located motor. U.S. Pat. No. 5,660,149 and U.S. Pat. No. 6,342,741, as well Published Application No. U.S. 2004/0223845 all disclose typical radiator cooling fans in which the motor is mounted at the center of the fan arrangement. This type of fan architecture suffers from one major drawback. Namely, in the event that the vehicle is being operated at a high, or even moderate, ground speed, such that ram air entering the vehicle at the front of the radiator would develop a sufficient pressure to force ambient air through the radiator, the fan blades and hub severely block the airflow. Although some fans are clutched with a thermostatic control so as to save energy, the blades and hub of such clutch fans block airflow to the central portion of the radiator, thus impairing the cooling capability of the radiator. In a nod to the possibility of using ram air cooling, U.S. Pat. No. 6,106,228 discloses louvers which open when a high pressure exists at the back of a radiator, so as to allow ram air to flow through the radiator. Unfortunately, the louvers of the '228 patent are not at the center of the radiator, where the cooling air would have the greatest beneficial effect. And, such louvers do not solve the problem of air blockage caused by the fan's hub.

A system according to the present invention utilizes a fan having an essentially hollow, fixed, annular hub which is louvered to allow controlled airflow. This allows the fan to efficiently pull air through the radiator when the hub louvers are closed, while permitting minimum restriction, and concomitantly, maximum airflow through the fan hub, when the louvers are open. This will allow optimal ram air cooling of the engine and radiator.

SUMMARY OF THE INVENTION

A cooling fan system for an internal combustion engine includes a fan shroud having a circular aperture formed therein and a stationary annular hub upon which an annular fan element is journaled upon at least one bearing interposed between an outer periphery of the hub and an inner periphery of the fan element. The fan element extends from the annular hub to the shroud's circular aperture. A number of louvers extend across the otherwise open inner portion of the annular hub, so as to control the flow of the air through the hub. A drive system powers the annular fan element.

According to another aspect of the present invention, a fan drive system may include a flexible power transmission member trained about at least part of a power input section of the annular fan element. The power transmission member extends from the power input section to a prime mover, which may be either a powered shaft such as a crankshaft or a camshaft associated with an engine, or a motor such as a hydraulic or electric motor. As another alternative, a fan element may be driven at its periphery by a motor geared to the fan element. This is sometimes termed a "ring motor".

As yet another alternative, the fan element may itself function as a rotor or armature of an electric motor, with the balance of the motor being located in the fan shroud.

The louvers mounted within the hub of the cooling fan system are moveable and have at least one open position allowing axial airflow past the louvers and through the hub, and a closed position in which either zero, or only minimal airflow is permitted past the louvers. The louvers may have either a rectangular configuration, or a semicircular, or an arcuate configuration, or other configurations known to those skilled in the art and suggested by this disclosure. The louvers are preferably hinged to the annular hub and may be either controlled by a resilient element, or by a controller through a mechanical linkage, such as a rack and pinion arrangement. Alternatively, the louvers may be actuated by electric motors attached directly to the louvers.

When the louvers are controlled by a resilient element, such as a torsion spring, the louvers will normally be closed, but will have an opening characteristic responsive to an air pressure differential across the hub. In situations in which the air pressure differential is such that opening the louvers will result in additional airflow through the radiator or other heat exchanger, the louvers are opened.

According to yet another aspect of the present invention, the present cooling system includes a controller for monitoring at least one operating parameter of a cooling system or powertrain, as well as other parameters such as the groundspeed of a vehicle upon which the cooling system is installed. The controller operates the fan drive system so as to reduce the rotational speed of the fan, while opening the louvers in the event that the vehicle has sufficient speed to force a predetermined quantity of ambient air past the louvers and through the radiator.

According to yet another aspect of the present invention, a fan drive system may include a flexible power transmission member trained about a sheave mounted at the inner periphery of the annular fan element, with the power transmission member extending to a motor. In this regard, the term motor also encompasses not only hydraulic or electric motor, but also a crankshaft or other rotating shaft to the engine.

It is an advantage of a cooling system according to the present invention that increased engine cooling may be achieved without expending the additional energy required to power a cooling fan.

It is a further advantage of a cooling system according to the present invention that in certain cases a cooling system radiator may be downsized because more efficient use of ram air is facilitated.

Other advantages, as well as features and objects of the present invention, will become apparent to the reader of this specification.

DETAILED DESCRIPTION OF THE PREFERRED EMBODIMENTS

Figure 1:
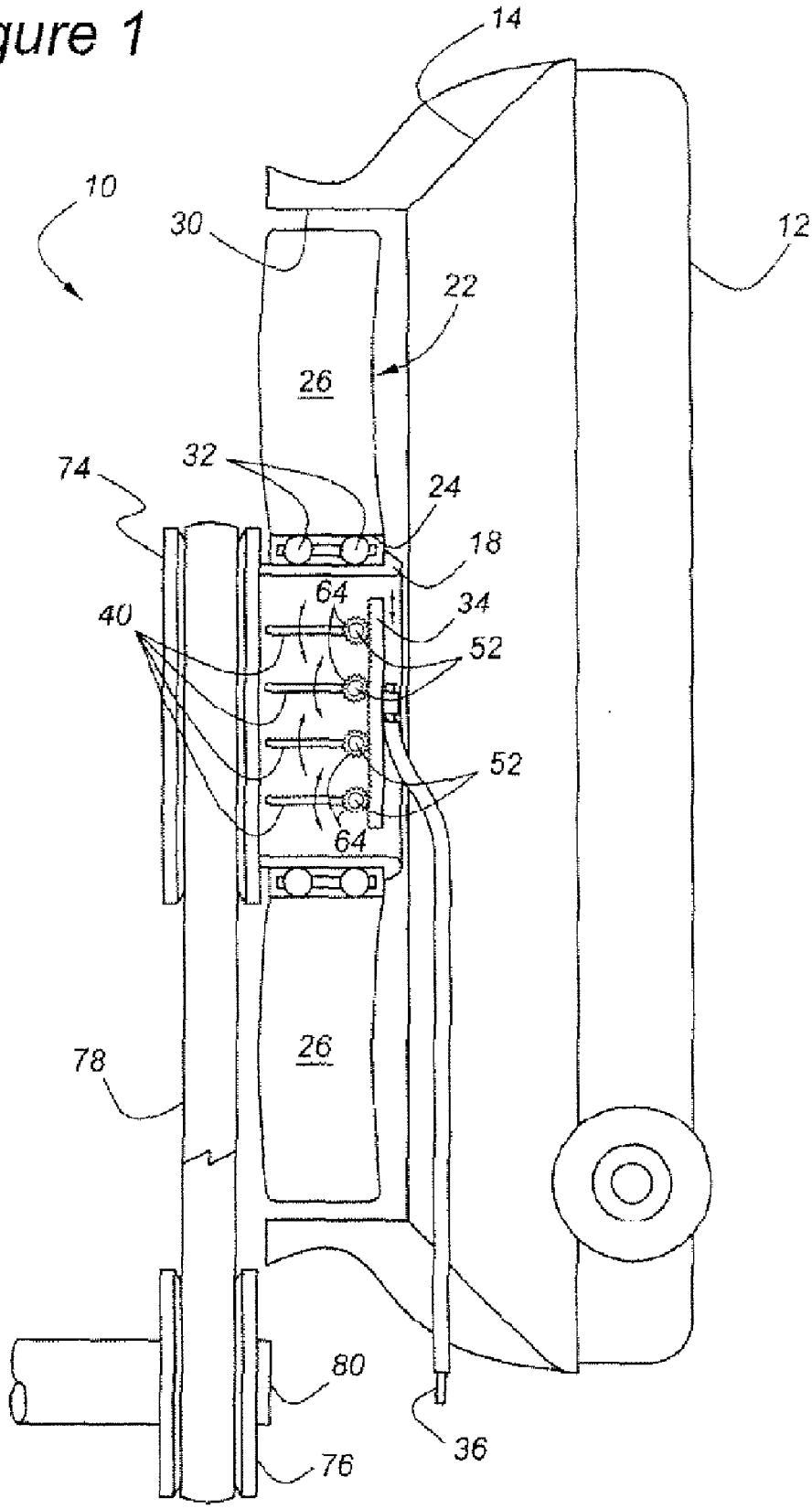
FIG. 1 is a partially schematic representation of a cooling system for an internal combustion engine according to the present invention.
Figure 4:
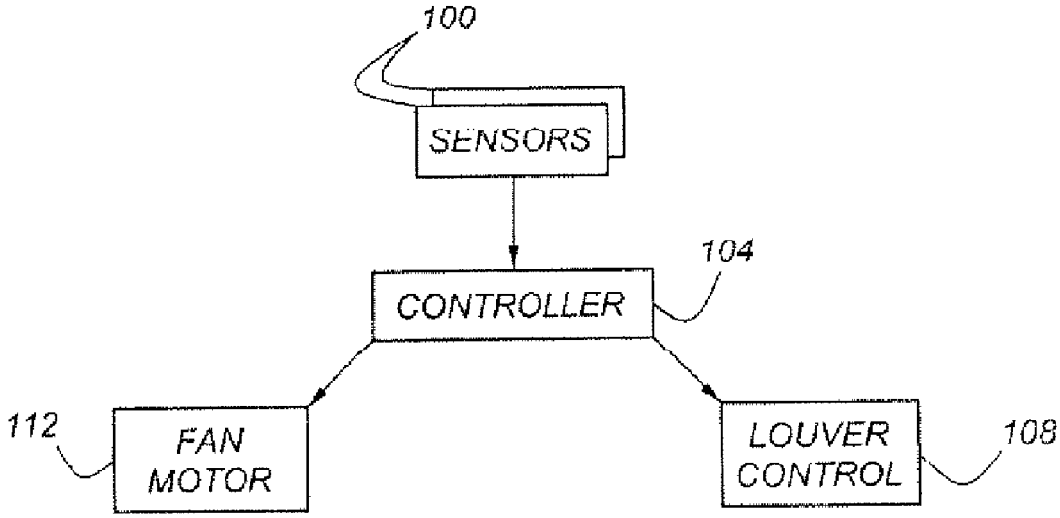
FIG. 4 illustrates a control system for operating a cooling system fan according to the present invention.

As shown in FIG. 1, cooling system 10 includes radiator 12, having fan shroud 14 mounted thereto. An axial flow fan element, 22, is mounted within a circular aperture, 30, formed in fan shroud 14. Fan element 22 has a number of fan blades, 26, which are mounted to circular bearing surface 24, which is an annular structure upon which each of the fan blades 26 is mounted. Bearing surface 24 defines the inner periphery of fan element 22. Bearing surface 24 and fan element 22 are journaled by means of bearings 32 to hub 18, which is stationary. Hub 18 may be mounted upon fan shroud 14, or upon another stationary engine part or vehicle part. What is important is that hub 18 does not rotate. Rather, fan element 22 rotates upon hub 18. This rotation is powered by means of sheave 74, belt 78 and sheave 76, which may be mounted to either a rotating engine shaft, such as crankshaft 80, or to a fan motor 112 (FIG. 4). Belt 78 thus serves as a flexible power transmission member trained about sheave 74, which serves as a power input section of annular fan element 22. As an alternative, fan motor 112 may include an electric or hydraulic motor geared to a peripheral ring gear mounted to fan element 22. As a further alternative, fan motor 112 may be partially incorporated into fan element 22, through utilization of fan element 22 as a rotor or armature in a motor, with the balance of the motor being mounted to fan shroud 14.

FIG. 1 shows a plurality of louvers, 40, which are attached by means of pivots 52 to hub 18. Pivots 52 are concentric with pinions 64. When louvers 40 are opened by means of rack 34, which operates upon pinions 64, louvers 40 open to allow essentially unrestricted airflow through hub 18. Rack 34 is operated by means of control cable 36, which is part of louver control 108 (FIG. 4).

Figure 2:
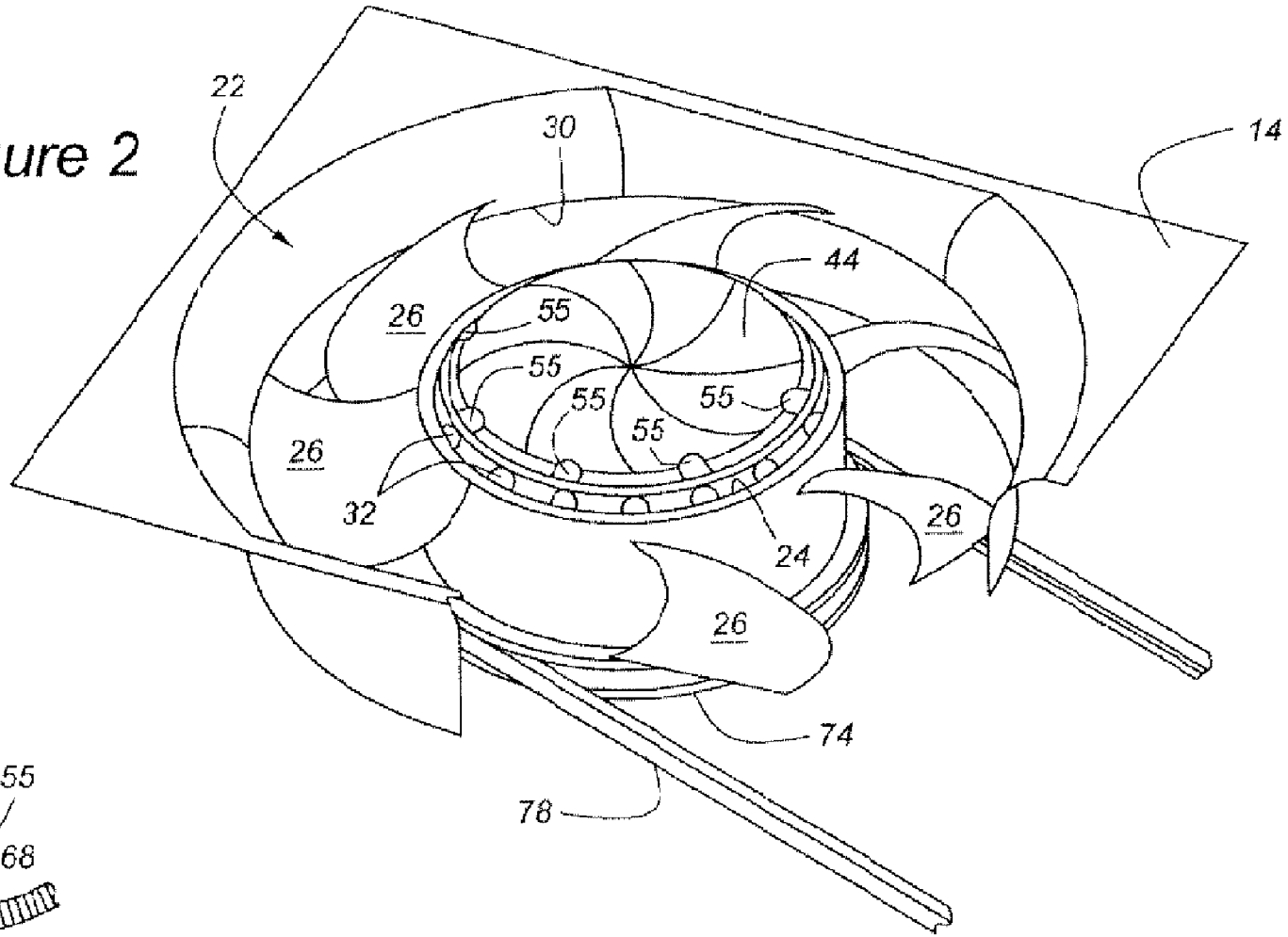
FIG. 2 is a perspective view of a cooling fan system according to the present invention.
Figure 5:
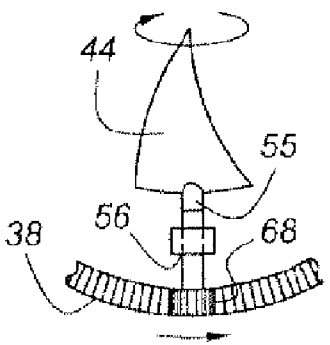
FIG. 5 illustrates further detail of louvers shown in FIG. 2.

In the embodiment of FIGS. 2 and 5, louvers 44 are pivotably attached to hub 18 at their outboard ends by means of stub shafts 55, which extend through pivots 56 (FIG. 5). Each of louvers 44 has a pinion gear, 68, mounted upon stub shaft 55. Pinion gears 68 mesh with ring gear 38 which is rotatably positioned upon hub 18 by a control cable (not shown) such as cable 36 of FIG. 1. Louvers 44 provide an unobstructed airflow path through hub 18 when the louvers are in an open position, but prevent any significant airflow through hub 18 when they are closed.

Figure 3:
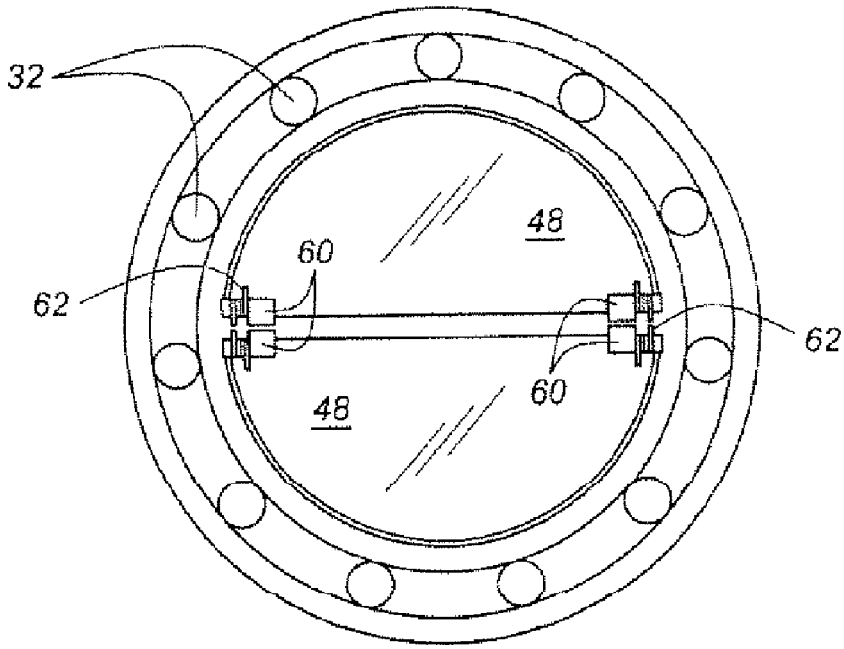
FIG. 3 shows a set of semicircular louvers according to one aspect of the present invention.

FIG. 3 illustrates a louver arrangement wherein louvers 48 are held in normally closed position by means of torsion springs 62, which are mounted about pivots 60. In response to dynamic air pressure in front of hub 18 i.e., pressure between fan element 22 and radiator 12, exceeding the pressure downstream of fan element 22 and hub 18, louvers 48 will be opened, allowing airflow through hub 18.

As shown in FIG. 4, a control system according to the present invention uses a plurality of sensors 100, which sense operating parameters such as vehicle speed, cooling fan speed, engine speed, and other vehicle, engine, and cooling system temperatures. Controller 104 uses the sensed information to control the fan's louvers and fan motor 112, which, as noted above, may comprise either an electrodrive or hydraulic motor, or other type of motor known to those skilled in the art and suggested by this disclosure. Controller 104 operates louver control 108. Two examples of active louver control are shown in FIGS. 1 and 2. In general, controller 104 will open louvers 40 or 44 in the event that sufficient airflow will pass through hub 18 without suction arising from fan blades 26.

The controller uses monitored parameters such as cooling system and powertrain temperatures, vehicle speed, and possibly other parameters and information, to actuate both the fan drive mechanism and louvers 40, 44 so as to obtain the desired airflow for a given situation. The controller may also be employed to minimize the power consumed by the fan, as well as minimizing the noise and vibration produced by the fan system. This necessitates the use of four fan system states in which:

The fan drive is not powered and the louvers are closed

The fan drive is not powered and the louvers are at least partially, if not fully open The fan drive is powered and the louvers are closed The fan drive is powered and the louvers are at least partially, if not fully open The controller will operate the fan system in one of these four states. It should be further noted that the position of the louvers may be fully open, fully closed, or anywhere in between. In certain systems, the controller may also be able to operate the fan drive across a range of levels which may discrete or continuous. The realm of control then extends to the complete combined operational space of both the louvers and the fan drive, so as to meet vehicular cooling and possibly other objectives such as minimal power consumption and quiet operation.

Although the present invention has been described in connection with particular embodiments thereof, it is to be understood that various modifications, alterations, and adaptations may be made by those skilled in the art without departing from the spirit and scope of the invention set forth in the following claims.

What is claimed is:

1. A cooling fan system for an internal combustion engine, comprising:

a fan shroud having a circular aperture formed therein;

a stationary, annular hub;

an annular fan element journaled upon said hub, with said fan element extending from said hub to said circular aperture in said shroud;

a plurality of louvers extending across an inner portion of said annular hub, so as to control the flow of air through said hub; and a drive system for powering said annular fan element.

2. A cooling fan system according to claim 1, wherein said fan element is an axial flow fan.

3. A cooling fan system according to claim 1, wherein said louvers are movable and have at least one open position allowing axial airflow past the louvers and through the hub, and a closed position in which only minimal airflow is permitted past the louvers.

4. A cooling fan system according to claim 1, wherein said drive system comprises a power transmission member engaging a power input section of said annular fan element, with said power transmission member extending to a prime mover.

5. A cooling system for an internal combustion engine, comprising:

a radiator for rejecting heat to ambient air;

a fan shroud mounted to said radiator and having a circular aperture formed therein;

an axial flow fan comprising an annular fan element having a circular bearing surface and a plurality of blades joined to said circular bearing surface and extending to the periphery of said circular aperture;

a generally annular stationary hub;

a plurality of movable louvers extending across at least part of said generally annular hub;

at least one bearing interposed between an outer periphery of said annular hub and said circular bearing surface of said fan element; and a rotational fan drive system operatively connected with said annular fan element.

6. A cooling system according to claim 5, wherein said louvers are normally closed and are hinged to said hub.

7. A cooling system according to claim 5, wherein said louvers are arcuately shaped and hinged to said annular hub.

8. A cooling system according to claim 5, wherein said louvers are hinged to said annular hub and urged into a closed position by a resilient element.

9. A cooling system according to claim 5, wherein said louvers are normally closed and have an opening characteristic responsive to an air pressure differential across said hub.

10. A cooling system according to claim 5, further comprising a controller for monitoring at least one operating parameter of the cooling system and at least one operating parameter of a vehicle upon which said cooling system is installed, with said controller operating said fan drive system so as to control the rotational speed of the fan and the opening position of said louvers.

11. A cooling system according to claim 10, wherein said operating parameter of the cooling system comprises a temperature of at least a portion of the cooling system, and said operating parameter of a vehicle comprises the vehicle's ground speed.

12. A cooling system for an internal combustion engine, comprising:

a radiator for rejecting heat to ambient air;

a fan shroud mounted to said radiator and having a circular aperture formed therein;

an axial flow fan comprising an annular fan element extending across said circular aperture in said shroud, with said fan element having an inner periphery;

an annular hub mounted to said fan shroud;

a plurality of controllable, normally closed louvers journaled to said hub and extending across an inner portion of said hub;

a plurality of bearings interposed between an inner periphery of said annular fan element and said hub;

a rotational fan drive system operatively connected with said annular fan element; and a controller for monitoring at least an operating temperature of the cooling system and the ground speed of a vehicle upon which said cooling system is adapted to be installed, with said controller operating said fan drive system and said louvers so as open said louvers in the event that the vehicle has sufficient speed to force a predetermined flow of ambient air through said radiator and past said louvers.

13. A cooling system according to claim 12, wherein said drive system comprises a power transmission member engaged with an outer periphery of said annular fan element, with said power transmission member extending to a motor.

14. A cooling system according to claim 12, wherein said drive system comprises a flexible power transmission member trained about at least part of a power input section of said annular fan element, with said power transmission member extending to a prime mover.

15. A cooling system according to claim 14, wherein said prime mover comprises a crankshaft of said engine.

16. A cooling system according to claim 12, wherein said controller further controls the speed of said fan by controlling said speed as a function of vehicle ground speed.

17. A cooling system according to claim 12, wherein said louvers are controlled by a ring gear rotatably mounted to said hub and operated by said controller, with said ring gear engaging a plurality of pinion gears attached to each of said louvers.

18. A cooling system according to claim 12, wherein said drive system comprises a flexible power transmission member trained about a sheave mounted at said inner periphery of said annular fan element, with said power transmission member extending to a motor.

19. A cooling system according to claim 18, wherein said motor comprises a hydraulic motor.

20. A cooling system according to claim 18, wherein said motor comprises an electric motor.

* * * * *